United States Patent [19]

Murase

[11] 4,424,402

[45] Jan. 3, 1984

[54] GAS-INSULATED BUSHING

[75] Inventor: Hiroshi Murase, Yokohama, Japan

[73] Assignee: Tokyo Shibaura Denki Kabushiki Kaisha, Kawasaki, Japan

[21] Appl. No.: 298,186

[22] Filed: Aug. 31, 1981

[30] Foreign Application Priority Data

Dec. 19, 1980 [JP] Japan ..... 55/178913

[51] Int. Cl.[3] ..... H01B 17/36; H01B 17/54; H01B 17/28

[52] U.S. Cl. ..... 174/16 BH; 174/31 R; 174/143

[58] Field of Search ..... 174/11 BH, 12 BH, 14 BH, 174/15 BH, 16 BH, 31 R, 142, 143, 152 R

[56] References Cited

U.S. PATENT DOCUMENTS 1,720,586 7/1929 Allan et al. ..... 174/99 E X

FOREIGN PATENT DOCUMENTS 46-15815 4/1971 Japan ..... 174/31 R
52-57995 5/1977 Japan ..... 174/16 BH
52-104798 9/1977 Japan ..... 174/143
54-18720 7/1979 Japan ..... 174/143

OTHER PUBLICATIONS

*EPRI Journal,* Oct. 1979, pp. 48 and 49.

*Primary Examiner*—Laramie E. Askin
*Attorney, Agent, or Firm*—Oblon, Fisher, Spivak, McClelland & Maier

[57] ABSTRACT

An improved gas-insulated bushing having a high withstand voltage and an increased capacity to cool a conductor, wherein the upper end portion of a potential-controlling capacitor in the form of a stopped tube is directly airtightly fitted to the outer surface of the central conductor, thereby enlarging a distance between the capacitor and the inner wall of the porcelain insulator and elevating the withstand voltage of the bushing; an internal pipe open at the bottom is inserted into the central conductor; the upper portion of the internal pipe communicates with a cooling case provided at the top of the porcelain insulator; a cooling gas is circulated through a route consisting of the cooling case, a space defined between the outer wall of the internal pipe and the inner wall of the central conductor and the interior of the internal pipe; and a cooling mechanism completely separated from an insulation gas chamber is provided in the central conductor, thereby enabling a cooling gas having a higher cooling capacity than an insulaton gas to be applied and elevate the cooling capacity.

10 Claims, 2 Drawing Figures

GAS-INSULATED BUSHING

BACKGROUND OF THE INVENTION

1. Field of the Invention

This invention relates to an improved gas-insulated bushing adapted for use with a high voltage device, and more particularly to an improved gas-insulated bushing which comprises a capacitor for equalizing an electric field prevailing over the surface of a porcelain insulator tube to thereby elevate the withstand voltage of said bushing, and means for cooling a conductor.

2. Description of the Prior Art

A large number of gas-insulated bushings are already known in this particular field which applies an insulating gas such as sulfur hexafluoride ($SF_6$) to insulate a conductor impressed with high voltage.

For example, the published Japanese utility model No. 54-18,720 sets forth a gas-insulated bushing, wherein a porcelain insulator tube is divided into two compartments by tightly fitting a capacitor constructed by airtightly embedding an electrode in thermosetting resin to the outer surface of a conductor; that of said compartments which surrounds the base portion of a conductor impressed with high voltage and does not contact the porcelain insulator tube is filled with high pressure gas; and that of said compartments whose outer wall is constituted by said porcelain insulator tube is filled with a gas having a relatively low pressure, thereby preventing the porcelain insulator tube from bursting and assuring a high withstand voltage of the bushing. However, this proposed gas-insulated bushing which lacked means for cooling a conductor was accompanied by the drawbacks that where power was introduced, the conductor was heated, resulting in an increase in its electric resistance and a decrease in its power transmission capacity.

The EPRI R&D Status Report (EPRI Journal October 1979, p. 48) discloses a gas-insulated bushing provided with a capacitor core prepared from epoxy resin-impregnated paper, and also a gas-insulated bushing whose porcelain insulator tube is filled with cycloaliphatic epoxy resin foamed with sulfur hexafluoride ($SF_6$) gas. However, neither of these proposed gas-insulated bushings is provided with an arrangement for cooling a conductor.

The prior art includes a gas-insulated bushing (FIG. 1) which is provided with conductor-cooling means, is so arranged as to prevent a porcelain insulator tube from bursting, and assures a high withstand voltage. With this conventional gas-insulated bushing, a potential control series-connected capacitor 3 in the form of a stepped tube surrounds a cylindrical conductor 2 set in a porcelain insulator tube 1, to thereby equalize an electric field prevailing over the surface of the porcelain insulator tube 1 and elevate the withstand voltage of said bushing. The lower part of the series-connected capacitor 3 is fixed to a tube-supporting metal part 5 by means of a support rest 4. The upper part of said series-connected capacitor 3 is fixed to a tube head-cooling case 7 by means of a cylindrical support metal part 6. The interior of said series-connected capacitor 3 defines a chamber 8 to be filled with high pressure insulating sulfur hexafluoride ($SF_6$) gas. A chamber 9 to be filled with low pressure insulating sulfur hexafluoride ($SF_6$) gas is provided outside of said series-connected capacitor 3. Therefore, the above-mentioned prior art gas-insulated bushing has an explosion-proof structure in which the porcelain insulator tube 1 is not directly subjected to high pressure. A high pressure insulation gas held in the chamber 8 flows into the central conductor 2 through a port 2*a* formed in the lower part thereof. When heated in the conductor, the insulation gas rises into the cooling case 7. When cooled there, the insulation gas flows downwardly. This rise-fall cycle of the insulation gas is repeated to effectively cool the conductor 2, thereby increasing its power transmission capacity.

With the above-mentioned construction of the prior art gas-insulated bushing, however, the return path of an insulation gas stream is positioned outside of the central conductor 2. Since the capacitor 3 has an increased diameter, the outer wall of part of the capacitor 3 and the outer wall of the cylindrical support metal part 6 are drawn near to the inner wall of the porcelain insulator tube 1. As a result, an electric field prevailing over the surface of the porcelain insulator tube is locally intensified, reducing the withstand voltage of the gas-insulated bushing and presenting difficulties in assembling said bushing. The conventional gas-insulated bushing has the further drawback that when subject to shocks like those of an earthquake, the capacitor 3 tends to touch the inner wall of the porcelain insulator tube, leading to the occurrence of difficulties.

OBJECTS OF THE INVENTION

It is accordingly an object of this invention to provide a gas-insulated bushing having an elevated withstand voltage.

Another object of the invention is to provide a gas-insulated bushing which allows for an easy assembly and in which the capacitor and porcelain insulator tube do not contact each other even when the bushing undergoes shocks.

Still another object of the invention is to provide a gas-insulated bushing which more effectively cools the central conductor than has been possible in the past and has an increased power transmission capacity.

SUMMARY OF THE INVENTION

To attain the above-mentioned objects and other objects apparent from the following description, this invention provides a gas-insulated bushing which comprises:

a conductor pipe;

a porcelain insulator tube surrounding said conductor pipe;

a capacitor in the form of a stepped tube which is set in a space defined between the pipe and porcelain insulator tube, whose upper part is airtightly fitted to the conductor pipe, and whose lower part is airtightly fitted to a support member of the porcelain insulator tube by means of a bonding member, and consequently whose inside and outside areas constitute independent insulation gas chambers;

a cooling case which is positioned at the top of the porcelain insulator tube and provided with a terminal electrically connected to the conductor pipe; and a hollow internal pipe which is enclosed in the conductor pipe, and communicates with the interior of the cooling case, and whose lower part is left open, and which is further fitted to the bottom of the cooling case in order to enable a passage defined between said internal pipe and conductor pipe to communicate with the interior of the cooling case, thereby causing the cooling gas to circulate through the interior of the cooling case and the inside and outside areas of the internal pipe.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 2:
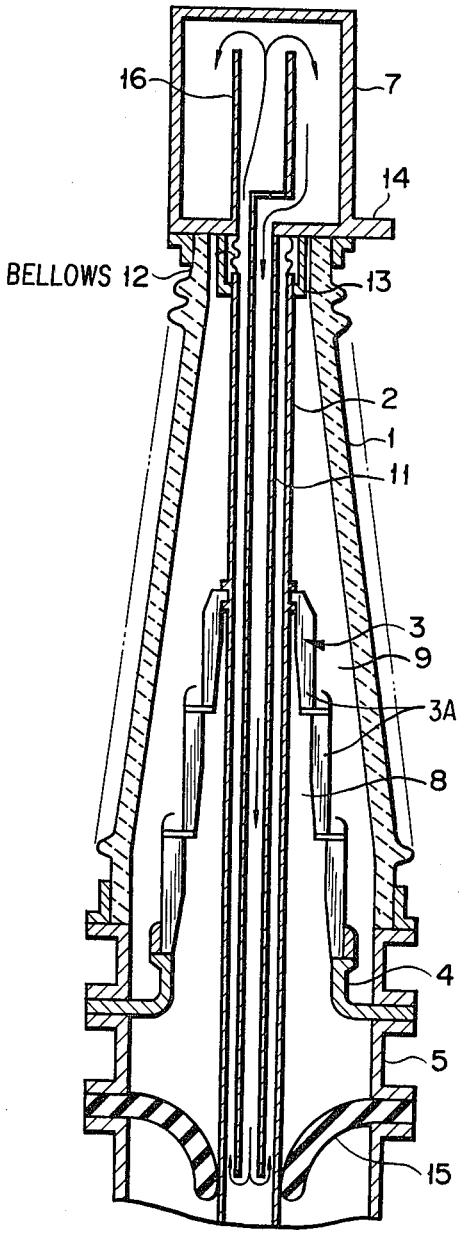
FIG. 2 is a longitudinal sectional view of a gas-insulated bushing embodying this invention.

With a gas-insulated bushing of FIG. 2 embodying this invention, the upper end portion of a series-connected potential control capacitor 3 is airtightly fitted to the central conductor 2. The inside area of said capacitor 3 constitutes a high pressure gas chamber 8, and the outside area thereof defines a low pressure gas chamber 9. The capacitor 3 includes a plurality of subcapacitor members 3A each having a substantially cylindrical shape, the thickness of the lower portion of each subcapacitor member being relatively small such that the inner diameter of each subcapacitor member is relatively large at a lower portion thereof. The near-bottom portion is partitioned by an insulation spacer 15 surrounding the central conductor 2. An internal pipe 11 open at the bottom is set inside of the central conductor 2. The inside and outside areas of the internal pipe 11 respectively define a cooling gas passage. The internal pipe 11 is fitted to the bottom of the cooling case 7 in order to allow the inside cooling gas passage to communicate with the lower portion of the cooling case 7 and the outside cooling gas passage communicate with the upper portion of the cooling case 7. A cooling gas circulates through a route consisting of the cooling case 7 and the outside and inside areas of the internal pipe 11 of the central conductor 2. A cooling gas-guiding device 16 is provided in the case 7. A cooling gas flowing between the internal pipe 11 and central conductor 2 into the cooling case 7 rises into the upper portion of the interior of the cooling case 7 and then flows downwardly by means of the guiding device 16. The upper end portion of the central conductor is airtightly connected to the cooling case 7 by means of bellows 12, thereby assuring absorption of the expansion and contraction of the central conductor 2 and the capacitor 3. This conductor 2 is electrically connected to the terminal 14 of the cooling case 7 by means of a slidable contact member 13. The parts of the gas-insulated bushing of this invention other than those described above have the same construction as those of the prior art gas-insulated bushing, description thereof being omitted.

Description is now given of the operation of the subject gas-insulated bushing. When heated by the hot conductor 2, a cooling gas flowing through the passage defined outside of the internal pipe 11 rises into the cooling case 7. After being cooled in the cooling case 7, the cooling gas runs down the inner wall of the internal pipe 11 and is discharged at the lower end of said pipe 11, and again flows into the outside passage thereof. The cooling gas repeats the above-mentioned running cycle. When contacted by the cooling gas running through the outside passage of the internal pipe 11, the hot conductor 2 is cooled.

Figure 1:
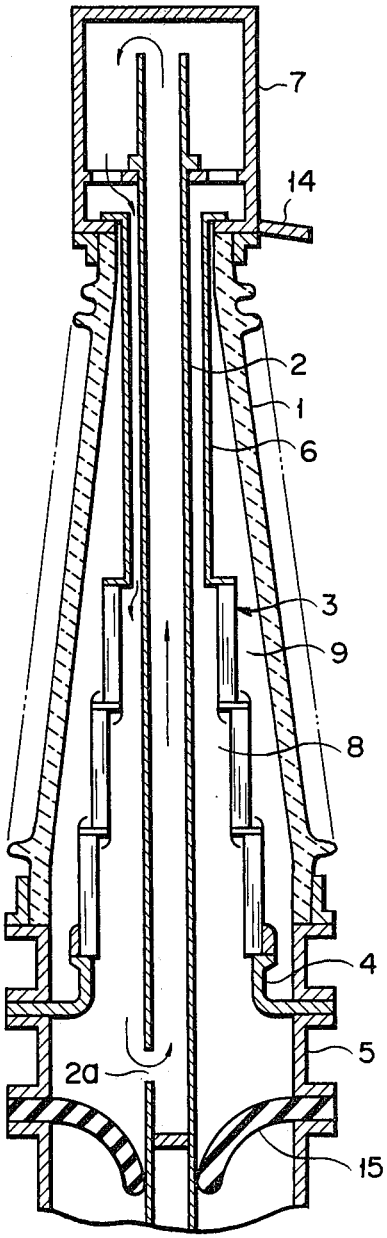
FIG. 1 PRIOR ART
FIG. 1 is a longitudinal sectional view of the prior art gas-insulated bushing.

With the conventional gas-insulated bushing of FIG. 1, the upper end portion of the series-connected capacitor 3 is fixed to the cooling case 7 by means of the cylindrical support metal part 6. In contrast, with the gas-insulated bushing of this invention, the upper end portion of the series-connected capacitor 3 is fitted to the central conductor 2 in airtightness. Therefore, the series-connected capacitor 3 of the present invention is prevented from being drawn extremely close to the porcelain insulator 1, assuring easy control of an electric field prevailing over the surface of the porcelain insulator 1 and elevation of its withstand voltage. Further advantages of the gas-insulated bushing of this invention are that the bushing can be easily assembled and when the bushing undergoes shocks like those of an earthquake, the capacitor 3 is prevented from being damaged by being contacted by the porcelain insulator 1.

Reference is now made to an insulation gas-cooling mechanism. With the prior art gas-insulated bushing of FIG. 1, the interior of the cylindrical conductor 2 communicates with the high pressure insulation gas chamber 8. An insulation gas of, for example, sulfur hexafluoride ($SF_6$) is concurrently applied as a cooling gas. In contrast, with the gas-insulated bushing of this invention shown in FIG. 2, the internal pipe 11 is inserted into the central conductor 2. A cooling gas circulates only through the cooling case 7, the central conductor 2 and also the internal pipe 11. Therefore, the interior spaces of the central conductor 2 and internal pipe 11 are completely separated from the high pressure insulation gas chamber 8 and low pressure insulation gas chamber 9. Therefore, a gas, for example, helium which has a higher cooling capacity than an insulation gas like $SF_6$ can be circulated through the conductor 2 and internal pipe 11, thereby assuring a higher cooling capacity than has been possible in the past.

As described above, this invention provides a gas-insulated bushing which has a high withstand voltage, effectively cools a conductor and assures easy manufacture.

It will be noted that this invention is not limited to the aforesaid embodiment. Obviously, the invention can be practiced with many changes and modifications or omissions without departing from the spirit, object and contemplation of the invention.

What is claimed is:

1. A gas-insulated bushing comprising:

(a) a conductor pipe;

(b) a porcelain insulator tube surrounding said conductor pipe;

(c) a support member for said insulator tube surrounding said conductor pipe and being airtightly fitted to said insulator tube;

(d) an insulator spacer airtightly disposed between said support member and said conductor pipe;

(e) a potential control series-connected capacitor in the form of a stepped tube composed of a plurality of subcapacitor members each having a substantially cylindrical shape, the thickness of the lower portion of each subcapacitor member being relatively small, such that the inner diameter of each subcapacitor member is relatively large at a lower portion thereof, said capacitor being disposed in the space between said conductor pipe and said porcelain insulator tube, an upper part of said capacitor being airtightly fitted to said conductor pipe and a lower part of said capacitor being airtightly fitted to said support member, whereby the space defined by the outside of said conductor pipe, the inside of said capacitor, the inside of said support member, and the top of said insulator spacer and the space defined by the outside of said conductor pipe, the outside of said capacitor, the inside of said insulator tube, and the outside of said support member constitute independent insulation gas chambers;

(f) a cooling case airtightly fitted to a top portion of said insulator tube;

(g) a terminal electrically connected to said conductor pipe;

(h) a bellows airtightly fitting an upper end portion of said conductor pipe to the bottom of said cooling case; and (i) a hollow internal pipe enclosed in said conductor pipe, the upper end of said internal pipe communicating with the interior of said cooling case, the lower end of said internal pipe being open-ended, and the upper end of the space between said internal pipe and said conductor pipe communicating with the interior of said cooling case, whereby, in use, cooling gas circulates up between the inside of said conductor pipe and the outside of said internal pipe, through said cooling case, down through the interior of said internal pipe, and back up between the inside of said conductor pipe and the outside of said internal pipe.

2. A gas-insulated bushing as recited in claim 1 wherein said terminal is electrically connected to said conductor pipe by means of a slidable contact member electrically connecting said conductor pipe to said cooling case, said cooling case in turn being electrically connected to said terminal.

3. A gas-insulated bushing as recited in claim 2 wherein said slidable contact member is disposed between the outer wall of said conductor pipe and an underside portion of a bottom wall of said cooling case.

4. A gas-insulated bushing as recited in claim 1 and further comprising a cooling gas guiding means disposed in said cooling case in fluid communication with the space between said internal pipe and said conductor pipe, said cooling gas guiding means being sized and shaped such that cooling gas flowing upwardly between said internal pipe and said conductor pipe into said cooling case is debouched into an upper portion of the interior of said cooling case and then flows downwardly into a lower part of the interior of said cooling case, and from there into the interior of said internal pipe.

5. A gas-insulated bushing according to claim 1 wherein the interior of said central conductor is filled with a gas having a higher cooling capacity than an insulating gas.

6. A gas-insulated bushing comprising:

(a) a conductor pipe;

(b) a porcelain insulator tube surrounding said conductor pipe;

(c) a support member for said insulator tube surrounding said conductor pipe and being airtightly fitted to said insulator tube;

(d) an insulator spacer airtightly disposed between said support member and said conductor pipe;

(e) a potential control series-connected capacitor in the form of a stepped tube disposed in the space between said conductor pipe and said porcelain insulator tube, an upper part of said capacitor being airtightly fitted to said conductor pipe and a lower part of said capacitor being airtightly fitted to said support member, whereby the space defined by the outside of said conductor pipe, the inside of said capacitor, the inside of said support member, and the top of said insulator spacer and the space defined by the outside of said conductor pipe, the outside of said capacitor, the inside of said insulator tube, and the outside of said support member constitute independent insulation gas chambers;

(f) a cooling case airtightly fitted to a top portion of said insulator tube;

(g) a terminal electrically connected to said conductor pipe;

(h) a bellows airtightly fitting an upper end portion of said conductor pipe to the bottom of said cooling case; and (i) a hollow internal pipe enclosed in said conductor pipe, the upper end of said internal pipe communicating with the interior of said cooling case, the lower end of said internal pipe being open-ended, and the upper end of the space between said internal pipe and said conductor pipe communicating with the interior of said cooling case, whereby, in use, cooling gas circulates up between the inside of said conductor pipe and the outside of said internal pipe, through said cooling case, down through the interior of said internal pipe, and back up between the inside of said conductor pipe and the outside of said internal pipe.

7. A gas-insulated bushing as recited in claim 6 wherein said terminal is electrically connected to said conductor pipe by means of a slidable contact member electrically connecting said conductor pipe to said cooling case, said cooling case in turn being electrically connected to said terminal.

8. A gas-insulated bushing as recited in claim 7 wherein said slidable contact member is disposed between the outer wall of said conductor pipe and an underside portion of a bottom wall of said cooling case.

9. A gas-insulated bushing as recited in claim 6 and further comprising a cooling gas guiding means disposed in said cooling case in fluid communication with the space between said internal pipe and said conductor pipe, said cooling gas guiding means being sized and shaped such that cooling gas flowing upwardly between said internal pipe and said conductor pipe into said cooling case is debouched into an upper portion of the interior of said cooling case and then flows downwardly into a lower part of the interior of said cooling case, and from there into the interior of said internal pipe.

10. A gas-insulated bushing according to claim 6 wherein the interior of said central conductor is filled with a gas having a higher cooling capacity than an insulating gas.

* * * * *